US006125754A

United States Patent [19]

Harris

[11] Patent Number: 6,125,754

[45] Date of Patent: Oct. 3, 2000

[54] WEB PRESSURIZING CHANNELED ROLLER AND METHOD

[76] Inventor: J. C. Harris, Rte. 2, Box 11, Dale, Ind. 47523

[21] Appl. No.: 09/182,935

[22] Filed: Oct. 30, 1998

[51] Int. Cl.[7] ..... B05C 1/08

[52] U.S. Cl. ..... 101/420; 101/425; 101/483; 101/424.1; 226/7; 226/195; 226/97.3; 271/195; 34/92; 34/521

[58] Field of Search ..... 101/420, 424.1, 101/425, 483, 228, 232, 409; 226/7, 97.1, 97.3, 97.4, 195; 271/12, 195; 34/92, 519, 521, 620; 242/156, 611

[56] References Cited

U.S. PATENT DOCUMENTS

| | | | |
|---|---|---|---|
| 579,141 | 3/1897 | Dunn . | |
| 595,669 | 12/1897 | Chadwick . | |
| 1,457,276 | 5/1923 | Isherwood . | |
| 2,176,835 | 10/1939 | Cumfer . | |
| 2,601,200 | 6/1952 | Amos et al. . | |
| 2,717,037 | 9/1955 | Goodwillie . | |
| 3,056,164 | 10/1962 | Reichel et al. . | |
| 3,405,884 | 10/1968 | Patterson . | |
| 3,513,645 | 5/1970 | Garrett et al. . | |
| 3,622,058 | 11/1971 | Vits | 226/7 |
| 3,828,998 | 8/1974 | Gross . | |
| 4,101,212 | 7/1978 | Sumiyoshi et al. . | |
| 4,165,132 | 8/1979 | Hassan et al. | 271/195 |
| 4,242,409 | 12/1980 | Parker . | |
| 4,276,911 | 7/1981 | Pfarrwaller . | |
| 4,428,724 | 1/1984 | Levy | 425/446 |
| 4,465,544 | 8/1984 | Fischer et al. . | |
| 4,493,548 | 1/1985 | Ateya | 271/195 |
| 4,552,295 | 11/1985 | Smith et al. | 226/195 |
| 4,566,162 | 1/1986 | Brands . | |
| 4,688,784 | 8/1987 | Wirz | 271/195 |
| 4,832,186 | 5/1989 | Conrad . | |
| 5,127,329 | 7/1992 | DeMoore | 101/420 |
| 5,188,273 | 2/1993 | Schmoock . | |
| 5,222,434 | 6/1993 | Smith et al. . | |
| 5,226,870 | 7/1993 | Smith et al. | 271/195 |
| 5,241,907 | 9/1993 | Dörsam | 101/409 |
| 5,243,909 | 9/1993 | DeMoore | 101/420 |
| 5,476,578 | 12/1995 | Forand et al. . | |
| 5,553,806 | 9/1996 | Lucas | 242/542.2 |
| 5,600,900 | 2/1997 | Marschke | 34/519 |
| 5,687,964 | 11/1997 | Stephan et al. | 271/195 |
| 5,775,623 | 7/1998 | Long | 226/97 |
| 5,797,327 | 8/1998 | Gieser et al. | 101/483 |
| 5,948,507 | 9/1999 | Chen et al. | 428/153 |

*Primary Examiner*—Eugene Eickholt
*Attorney, Agent, or Firm*—Sanford J. Piltch

[57] ABSTRACT

The present invention is a channeled roller, used in association with flexible webs, which is provided with a pressurized gas flow, and which may be used to remove web wrinkles, clean webs and rollers, brake rollers, and heat, cool, moisturize, and dry webs. In operation, gas flow travels through the roller channels and applies non-contact forces to the web, thereby removing wrinkles and providing other types of beneficial web treatment.

20 Claims, 4 Drawing Sheets

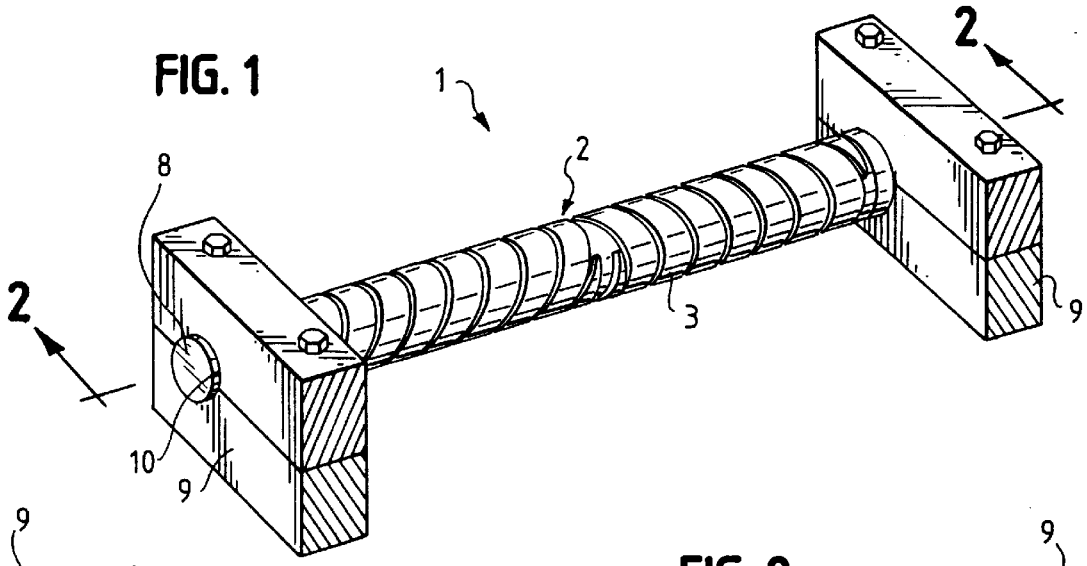
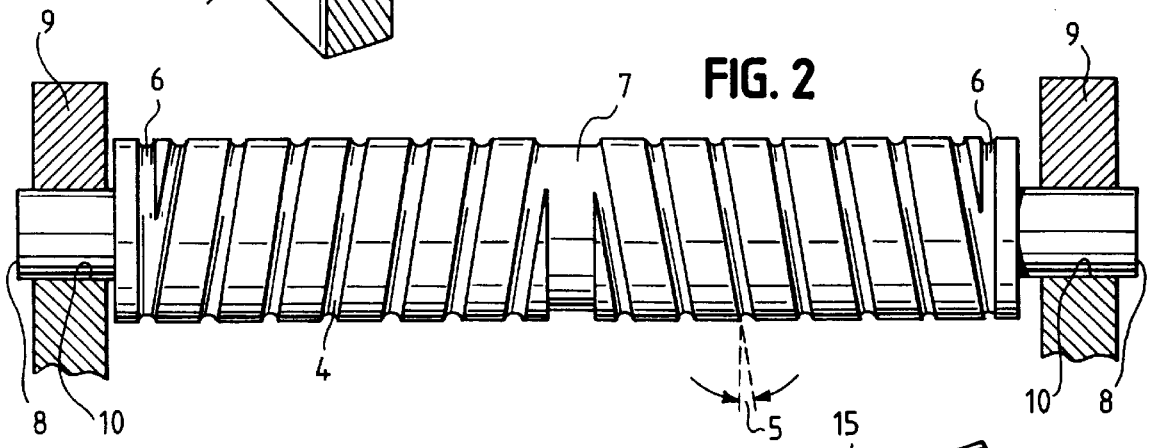
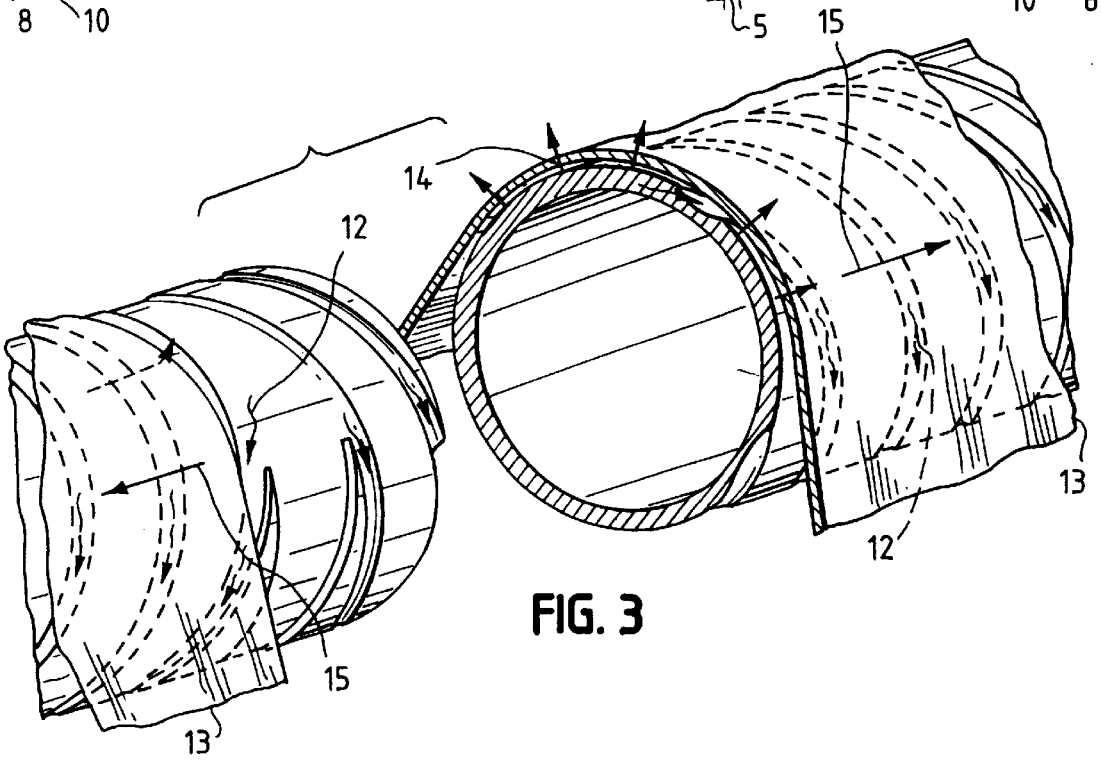
FIG. 3

WEB PRESSURIZING CHANNELED ROLLER AND METHOD

FIELD OF THE INVENTION

This invention relates generally to rollers used for paper printing, as well as the manufacture of paper, cloth, metal, plastic, and other flexible materials. In particular, this invention relates to a roller used in manufacturing lines for winding and unwinding webs of flexible materials, where a non-contact gas pressure force or suction force is created underneath the webs for removing wrinkles in the webs and for providing various kinds of treatment to the webs.

BACKGROUND OF THE INVENTION

In numerous industries continuous sheets of material, commonly referred to as "webs," pass over rollers at relatively high speeds. A persistent web problem is the formation of cross-web wrinkles. Varying longitudinal tension, air resistance, operating vibrations, and other factors play roles in causing cross-web wrinkles. Materials particularly prone to wrinkling are paper, fabric, and plastic film. In the printing industry, web wrinkling is especially problematic when webs wrinkle before the ink dries.

There are several known techniques for removing web wrinkles which involve physically contacting and manipulating the web. Numerous compressible rubber rollers with various surface configurations have been developed, which are pressed against webs for wrinkle removal. Recently, pivoting rollers for tension equalization have been used to remove wrinkles, as illustrated by U.S. Pat. No. 5,727,753 invented by J. C. Harris, the inventor of this present invention.

Channeled Rollers: Web Contact Techniques

Also well known is the use of rollers which are channeled, fluted, or spiraled, to make contact with and to physically manipulate webs. Channeled rollers have been largely used to oil, wet, move, stretch, guide, or cut webs, or to crush webbed materials by means of physical contact between the channel lands and the web. (A channel land is an outward portion which is the inverse of the channel and adjacent to the channel).

Wrinkle Removal

Well known techniques for removing wrinkles with channeled rollers are disclosed in U.S. Pat. No. 3,828,998 [Gross] (helically bladed roller used to remove wrinkles in web through frictional contact between blades and web); U.S. Pat. No. 4,101,212 [Sumiyoshi] (channeled roller used to press an image transfer web onto a photosensitive plate and to remove any wrinkles in the web by means of frictional contact between channel lands and the web); and U.S. Pat. No. 4,276,911 [Pfarrwaller] (channeled roller used in a fabric take-off apparatus, to prevent the formation of folds by means of frictional contact between the channel lands and the fabric web).

Two techniques have specifically addressed the problem of wrinkle formation through web stretching, as disclosed in U.S. Pat. No. 4,566,162 [Brands] and U.S. Pat. No. 5,188,273 [Schmoock] (channeled rollers used to stretch webs and prevent wrinkle formation in webs by means of frictional contact between the channel lands and the web).

Liquid Applications

There are various liquid applications for channeled rollers, as disclosed in U.S. Pat. No. 579,141 [Dunn] (channeled roller used to oil and season hides and skins by means of collecting oil in roller channels and distributing oil onto hides and skins); U.S. Pat. No. 595,669 [Chadwick] (channeled roller used to oil skins for the preparation of leather by means of collecting oil in roller channels and distributing oil on skins); U.S. Pat. No. 4,465,544 [Fischer] (channeled roller used to redistribute paste as it builds up on a pasting roller, by means of frictional contact between the channel lands and the paste on the pasting cylinder); and U.S. Pat. No. 5,222,434 [Smith] (channeled roller used in printing press to collect ink in channels and feed ink through a printing press).

Crushing

Channeled rollers have also been used to crush various materials, as disclosed in U.S. Pat. No. 3,513,645 [Garrett] (two or more channeled rollers used to crush hay and other crops by means of pressing the web between two channeled rollers) and U.S. Pat. No. 4,242,409 [Parker] (two or more channeled rollers used to crush or crimp webs for reinforcing non-woven mats and giving mats flame retardation qualities).

Fabric Spreading

There are known techniques for using channeled rollers to separate and spread fabric, as disclosed in U.S. Pat. No. 1,457,276 [Isherwood] (channeled roller used to spread cloth in cloth handling machines by means of frictional contact between channel lands and cloth) and U.S. Pat. No. 2,717,037 [Goodwillie] (channeled roller used to separate relatively narrow webs, which originated from a single, larger web, by means of frictional contact between channel lands and the web).

Web Alignment

In addition, channeled rollers have been used to align webs, as disclosed in U.S. Pat. No. 2,176,835 [Cumfer] (channeled roller used to prevent web mis-tracking or slippage and to remove excess asphalt from web by means of frictional contact between channel lands and the web) and U.S. Pat. No. 4,832,186 [Conrad] (channeled roller used to maintain the alignment of webs over rollers by means of frictional contact between the channel lands and the web).

The diverse foregoing techniques all involve physical contact with a web in order to physically manipulate the web. These techniques have limited success when used with delicate webs or webs in printing and imaging applications. Physical manipulation of delicate webs is known to cause undesired web marking, micro-fractures, tears, and a general decrease in web tensile strength. In printing and imaging applications, the ink or images are smeared and damaged when the web is physically manipulated with a roller.

Channeled Rollers: Web Non-Contact Techniques

Channeled rollers have previously been used in manners other than for contacting a web and physically manipulating it. U.S. Pat. No. 3,405,884 [Patterson] discloses a channeled roller used to remove excess air from underneath a web in order to prevent web misalignment. The channel lands make physical contact with the web. The channels act as vents, enabling air to escape from between the roller and the web, to the ambient atmosphere.

The Patterson patent did not disclose a technique for removing web wrinkles. It disclosed a technique for air removal. Even if applied to the wrinkle problem, the technology disclosed in the Patterson patent could not be used to remove cross-web wrinkles without the channel lands physically contacting and manipulating the web.

In a different application, air bars have been used in web accumulators to maintain proper web tension, as disclosed in U.S. Pat. No. 5,775,623 [Long]. During web processing, there is often a need to isolate one web from another for a certain amount of time. Web accumulators are used for this purpose. The disclosed web accumulator involved two vertical, parallel plates having air bars mounted on their top edges. The vertical plates discharge pressurized air, forming a pressurizing chamber.

The web rests upon one air bar, recedes down into the chamber, and rests upon the other air bar. The air bars are smooth surfaced, porous bars which discharge pressurized air onto the web. The purpose of the air bars is to enable new web material to enter the chamber for accumulation, without damaging the web.

The air bars disclosed in the Long patent could not be used to remove cross-web wrinkles because the bars are not channeled. Consequently, the air discharged from the air bars only provides a radial force, not a force along the width of the web. With no forces being applied across the web width, cross-web wrinkles will not be removed.

In addition to the need for non-contact wrinkle removal, in numerous industries there is a need to treat webs during the manufacturing process through heating, cooling, moisturizing, drying, or otherwise treating webs through the application of particular gases. One known technique for heating and cooling webs is passing temperature regulated fluid through the center of a roller. The fluid heats or cools the roller, and as the web passes over the roller, the web is heated or cooled. Heating and cooling rollers in order to regulate web temperature is inefficient. The energy required for roller heating and cooling can be prohibitively expensive.

Known techniques for moisturizing and drying webs are nozzle spraying and using fans to blow mist onto the webs. These moisturizing techniques have the disadvantage of condensation formation, dripping, and non-uniform moisturization, all of which cause web weakening and tearing.

Furthermore, these known techniques do not offer a single system which successfully addresses web wrinkle removal and prevention, web heating and cooling, web drying and moisturization, removal of dust and debris from webs and rollers, and roller braking.

From all of the foregoing discussion, it is quite apparent that a significant need exists for a roller which addresses the recognized problems which have faced manufacturers of flexible materials and printed paper for so long without a viable solution.

Accordingly, an object of the present invention is to provide a roller which creates web tension for wrinkle removal and prevention by means of gas pressure.

Another object of the present invention is to provide a roller which heats and cools webs by means of relatively hot or cold gas pressure.

An additional object of the present invention is to provide a roller which drys or moisturizes webs by means of relatively dry or moist gas pressure.

Still another object of the present invention is to provide a roller which cleans webs and rollers by means of air suction pressure.

Yet another object of the present invention is to provide a roller which has a gas pressure-based braking system.

SUMMARY OF THE INVENTION

There now has been discovered a roller which creates a gas pressure underneath the web. The gas is preferably air, though it may be any other gas, steam or any other substance which flows continuously. The roller surface is engraved, creating helical channels around the entire cylindrical surface, having a chevron configuration at the middle of the roller.

In forced pressure operation, gas is forced into the channels and flows circumferentially around the roller surface. At a preferred forced pressure, the gas moves radially from the channels to the underside of the web, applying pressure forces to the underside of the web. The pressure forces displace and stretch the web until the web is taut, thereby removing wrinkles from the web.

In suction pressure operation, air gas is drawn through the channels by means of suction pressure. At a preferred suction pressure, suction forces are applied to the underside of the web. The suction forces displace and stretch the web until the web is taut, thereby removing wrinkles from the web.

In a preferred embodiment, a duct is used to force gas into the channels or to draw in air from the channels. The duct is semi-cylindrical in shape and fits around and in close proximity to the roller surface. A power source supplies the duct with forced pressure or suction pressure, depending upon the particular application. The power source creates a continuous flow of gas throughout the channels. The gas flows circumferentially around the cylindrical surface. The gas flow creates pressure forces or suction forces that push out or pull in the web and stretch the web, removing wrinkles.

The duct may be made of a one-piece cover or a two-piece cover, depending upon factors such as wrinkle frequency, web size, web weight, web material, and web speed. The use of a duct with a two-piece cover increases the pressure and suction forces applied to the web.

In another preferred embodiment, gas or air passes directly through the interior of the roller. A power source is connected to a hose which, in turn, is connected to one end of the roller. The other end of the roller is closed. Two or more holes are formed through the roller surface.

In forced pressure operation, the power source forces gas through the hose and into the roller. As pressure accumulates inside the roller, gas is forced through the holes. As the roller rotates, at certain positions its holes are momentarily located underneath the web. In these positions, the gas flows out of the holes and makes contact with the web. The web forms a boundary, re-directing the gas onto the cylindrical surface and into the channels, creating a continuous flow throughout the channels. The gas then flows circumferentially around the cylindrical surface. The gas flow creates pressure forces that push out the web and stretch the web, removing wrinkles.

In suction pressure operation, the power source draws in air through the channels. A vacuum is created between the web and the cylindrical surface. Air is drawn into the channels, through the holes, into the roller, and through the hose. The gas flows circumferentially around the cylindrical surface. The gas flow creates suction forces that pull in the web and stretch the web, removing wrinkles.

The power source for all embodiments is preferably a pump which can provide pressure force or suction force, and which can heat and cool gas.

Aside from removing wrinkles, depending upon the kind of gas used, the pressure forces or suction forces may be used to treat the web in a variety of ways, including but not limited to ink drying, web drying, heating, cooling, softening, moistening, roller cleaning, or roller braking.

BRIEF DESCRIPTION OF THE DRAWINGS

For the purposes of illustrating this invention, there is shown in the drawings, embodiments which are presently preferred; it being understood, however, that the invention is not limited to the precise arrangements and instrumentalities shown.

FIG. 1 is a perspective view of the channeled roller of the present invention.

FIG. 2 is a front view of the channeled roller of the present invention.

FIG. 3 is a partial perspective view of the channeled roller operated with forced pressure of the present invention showing the wrinkles, gas flow, and stresses.

DETAILED DESCRIPTION OF THE PREFERRED EMBODIMENTS

Figure 4:
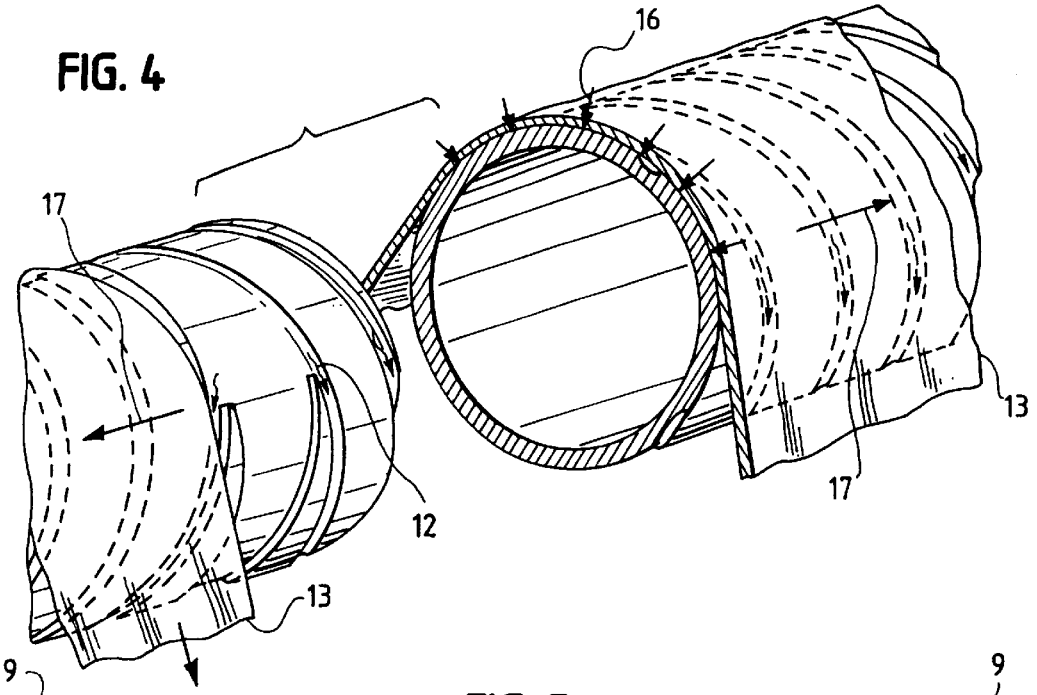
FIG. 4 is a partial perspective view of the channeled roller operated with suction pressure of the present invention showing the wrinkles, gas flow, and stresses.

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Referring to the drawings in detail, where like numerals refer to like parts or elements, and in particular to FIG. 1, there is shown a web pressurizing channeled roller 1, consisting of roller 2 and roller surface 3. Roller 2 preferably has a 0.50 inch thick wall, and is made of steel drawn over mandrill (DOM) tubing, having an inner diameter of 3.00 inches and an outer diameter of 4.00 inches. However, roller 2 may be made of aluminum, chrome plated tubing, rubber, or any other material which is suitable for the particular application. The length of web pressurizing channeled roller 1 is preferably 60.00 inches, and the diameter is preferably 4.00 inches, however the length and diameter may vary, depending upon the particular application.

As can be seen in FIG. 2, channels 4 are formed in roller surface 3. Channels 4 are preferably formed by means of die cutting, though any other suitable means of cutting, machining, engraving, etching, or molding may be used. Channels 4 are preferably formed with a range of 1.00 inches to 2.00 inches being between the center of each channel 4, though any other suitable distance may be used. As shown in FIG. 2, on one half of roller surface 3, channels 4 are preferably formed at an acute angle 5 in the range of 5.00 to 30.00 degrees with respect to the axis perpendicular to the axis of rotation. On the other half of roller 2, channels 4 are preferably formed at an acute angle 5, in a manner such that channels 4 on one half of roller 2 are not parallel to channels 4 on the other half of roller 2, but rather the channels 4 on each half are mirror images of one another. The opposing channels 4 join at the mid-point of roller 2 by means of a chevron configuration.

Channels 4 on opposite halves of roller 2 are symmetrically designed to direct gas flow 12 from the mid-point of roller 2 to the ends of roller 2. End channels 6 at the ends of roller 2 are not formed at angle 5, but rather are formed perpendicular to the axis of rotation. Channels 4 and end channels 6 are preferably in the range of 0.10 to 0.30 inches deep and in the range of 0.25 to 0.75 inches wide, though these dimensions may be modified to adjust the performance of web pressurizing channeled roller 1. Reservoir 7, as shown in FIG. 2, is located at the mid-point of roller 2. Reservoir 7 is preferably in the range of 0.50 to 2.00 inches wide and in the range of 0.10 to 0.30 inches deep, though these dimensions may be modified to adjust the performance of web pressurizing channeled roller 1.

As shown in FIGS. 1 and 2, a supporting shaft 8 provides a means to connect roller 2 to mounts 9. Roller 2 may freely rotate upon supporting shaft 8. Alternately, roller 2 may be fixedly attached to supporting shaft 8 while supporting shaft 8 freely rotates at mount holes 10 in the mounts 9. As is customary in the manufacture of flexible materials, mounts 9, made of iron, steel, or any other hard material, are used to support roller 2 by providing support for supporting shaft 8. Mount holes 10 are preferably formed into mounts 9 by means of casting, though molding, cutting, or any other suitable means of hole formation may be used. The upper portion of mounts 9 is removable by means of bolts, and may be removed for changing rollers.

In forced pressure operation, forced pressure from a power source 11, shown later, causes gas to flow into reservoir 7, and the gas flows from reservoir 7 into channels 4. Gas flow 12 travels circumferentially through channels 4 and in a cross-web manner towards both ends of roller 2. As shown in FIG. 3, the gas flow 12 generates two kinds of forces which act on web 13: normal pressure forces 14 and shear pressure forces 15. The gas moves radially outward and creates normal pressure forces 14 on the underside of web 13. Normal pressure forces 14 displace web 13 until it is taut, thereby contributing to removing wrinkles from web 13.

The cross-web flow of the gas creates shear pressure forces 15 on the underside of web 13. As shown in FIG. 3, shear pressure forces 15 on one half of roller 2 act in the opposite direction of the shear pressure forces 15 on the other half of roller 2. The effect of the opposing shear pressure forces 15 is a stretching of web 13 which contributes to removing wrinkles from web 13.

Alternatively, power source 11 may be used to provide suction forces on web 13 instead of pressure forces. Suction forces located near the ends of roller 2 will efficiently pull air into end channels 6. Since end channels 6 are perpendicular to the axis of rotation, the suction forces will be constantly applied to end channels 6 during rotation of roller 2. Suction forces located near end channels 6 will pull air through end channels 6, which in turn will pull air through the channels 4. As shown in FIG. 4, a vacuum effect will induce a gas flow 12 of air going from reservoir 7 to each end of roller 2. The suction force creates two kinds of forces which act on web 13: normal suction forces 16 and shear suction forces 17, shown in FIG. 4. The air moves radially inward and creates normal suction forces 16 pulling the underside of web 13 towards roller surface 3. Normal suction forces 16 displace web 13 until it is taut, thereby contributing to removing wrinkles from web 13.

The cross-web gas flow 12 of the air caused by suction pressure creates shear suction forces 17 on the underside of web 13 acting in opposite directions. As shown in FIG. 4, shear suction forces 17 on one half of roller 2 act in the opposite direction of the shear suction forces 17 on the other half of roller 2. The effect of the opposing shear suction forces 17 is a stretching of web 13 which contributes to removing wrinkles from web 13.

In addition to removing wrinkles, the distribution of relatively hot gas underneath web 13 may be used to dry web 13, particularly in printing applications. The distribution of relatively cold gas may be used to cool web 13 materials. The use of relatively hot or cold gas may be used to control the expansion and contraction of web 13, caused by varying manufacturing operating temperatures.

In addition, the distribution of relatively moist gas, such as vapor or steam, may be used to decrease the rigidity of web 13, making it more pliable, and enhancing embossing capabilities. Conversely, the distribution of relatively dry gas may be used to increase the rigidity of web 13 for particular applications.

Also, when a suction pressure is used, the suction pressure may be used to clean roller surface 3 as well as clean the underside of web 13. Such suction pressure will remove debris, including, but not limited to, paper fiber, dust, lint, loose web material particles, and other forms of matter which tend to collect on rollers and webs during the manufacturing process. Suction pressure may also be used to dry web 13.

Figure 5:
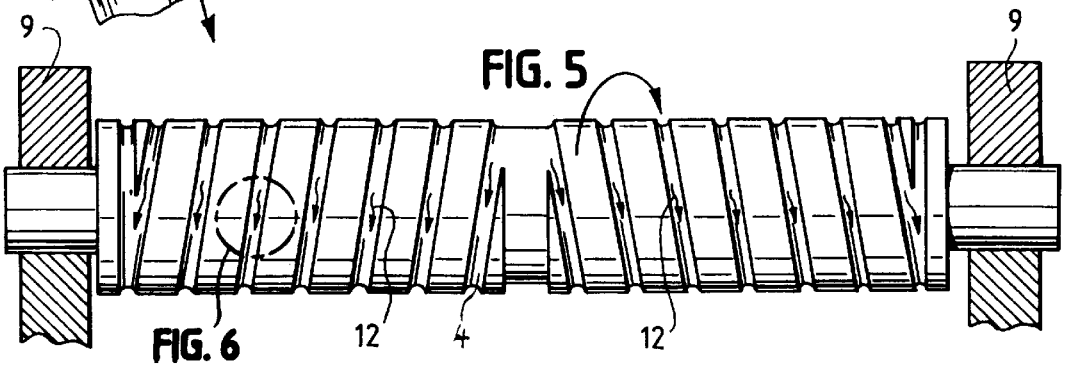
FIG. 5 is a front view of the channeled roller of the present invention, showing gas flow.
Figure 6:
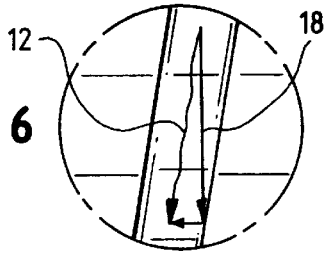
FIG. 6 is a partial front view of the channeled roller of the present invention, showing the braking force.

Furthermore, either forced pressure or suction pressure may be used as a braking system to bring roller 2 to a stop. When gas is forced through channels 4, the gas flow 12 applies a rotating force to roller 2 due to the angle 5 of channels 4. In particular, as shown in FIGS. 5 and 6, a braking force 18 may be applied along the channels 4 so as to decrease the speed of roller 2 by selecting the direction of gas flow 12 which opposes the rotation of roller 2. The gas flow 12 direction can be changed by using forced pressure instead of suction pressure, or vice versa. Thus, a large enough pressure force or suction force provided by power source 11 will brake roller 2 and bring it to a stop.

Figure 7:
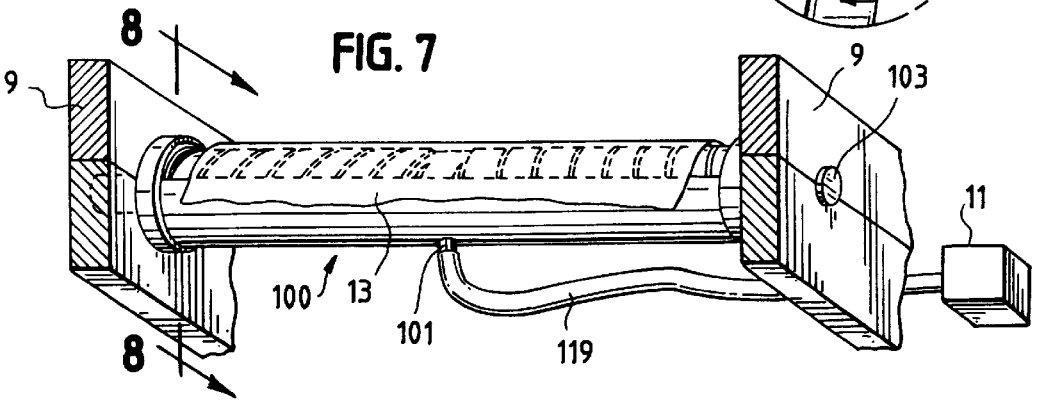
FIG. 7 is a perspective view of the first embodiment of the present invention.
Figure 8:
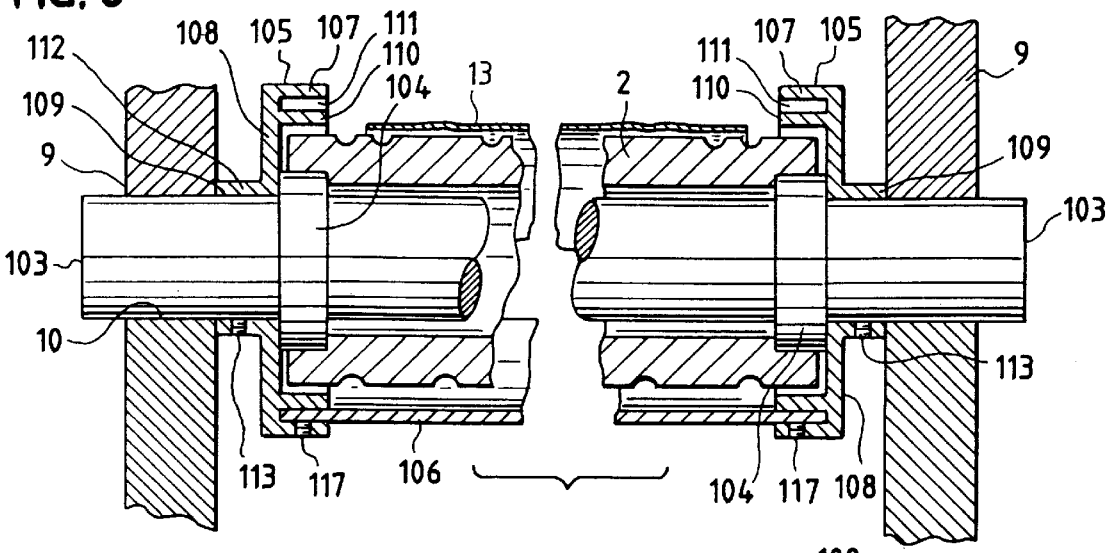
FIG. 8 is a cross-sectional view of the first embodiment of the present invention.
Figure 9:
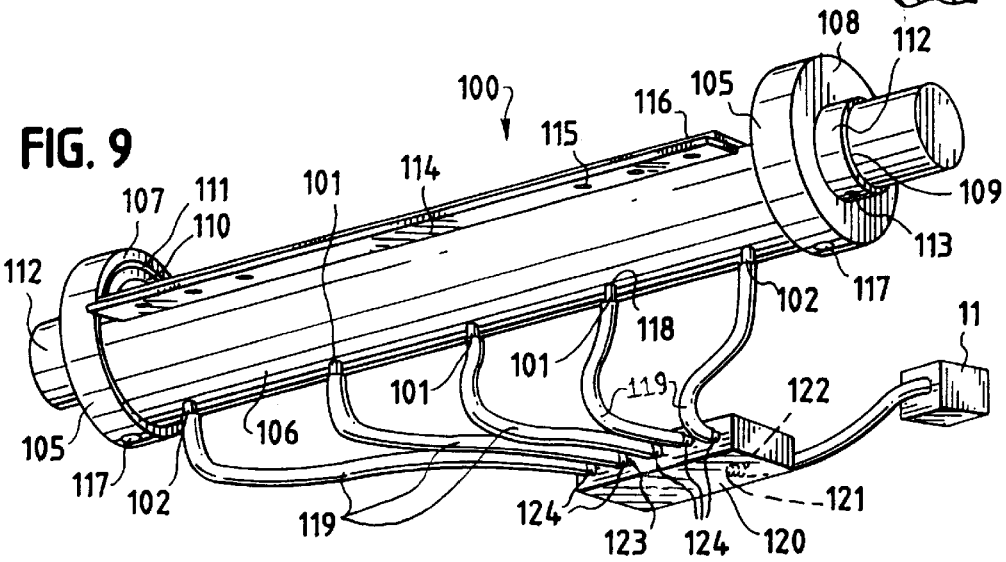
FIG. 9 is a perspective view of the one-piece duct for the first embodiment of the present invention, as connected to the power source.

In the first preferred embodiment shown in FIGS. 7–11, power source 11 supplies one-piece duct 100 with a pressure force at forced pressure conduits 101 or alternatively with a suction force at suction pressure conduits 102, shown in FIG. 9. Internal shaft 103 is stationary. Internal shaft 103 extends through roller 2 and is preferably made of cold rolled steel, though any other hard material which is capable of supporting roller 2 may be used. As shown in FIG. 8, at least two internal shaft bearings 104 are fit over the ends of internal shaft 103. Internal shaft bearings 104 are held in place by means of set screws, not shown. Internal shaft bearings 104 are preferably straight roller ball bearings having an outer diameter of 3.14 inches, a bore of 1.50 inches, and a width of 1.00 inch. However, any other suitable groove dimensions and bearings may be used. Internal shaft bearings 104 make contact with the interior of roller 2, allowing roller 2 to freely rotate upon internal shaft 103. Internal shaft 103 is immovably attached to mounts 9 at mount holes 10, preferably by means of the upper portion of mounts 9 being bolted to its lower portion, entrapping internal shaft 103.

One-piece duct 100 is comprised of rims 105 and one-piece cover 106, as shown in FIGS. 7–9. Rims 105 are made of rim cylinders 107 having a circular rim cap 108 on one end of each rim cylinder 107. Rim cap 108 has the same diameter as rim cylinder 107. A rim hole 109, slightly larger than the diameter of internal shaft 103, is formed through the center of rim cap 108. Inner rim cylinder 110 has a smaller diameter than rim cylinder 107, a larger diameter than rim hole 109, and no end caps. Inner rim cylinder 110 is attached to rim cap 108 on the inside of inner rim cylinder 107. Rim slots 111 are the empty spaces between rim cylinders 107 and inner rim cylinders 110. As can be seen in FIGS. 8 and 9, rim mounting cylinders 112, having diameters equal to rim holes 109, are attached to rim cap 108 on the backside of rim cylinder 107. Rim mounting cylinders 112 have no end caps. Rims 105 are preferably made of 16 gauge galvanized steel, though any other suitable material may be used such as aluminum, plastic, fiber glass, and other steels. Rims 105 are preferably made of one piece of steel through a sheet-metal forming process, involving punching, stamping, bending, and forming.

Rims 105 are attached to the ends of internal shaft 103 by sliding the rim mounting cylinders 112 onto the ends of internal shaft 103. A rim set screw 113, one for each rim 105, is screwed through rim mounting cylinders 112 until the end of the rim set screw 113 reaches internal shaft 103. Rim set screws 113 are screwed until rims 105 fit tightly onto internal shaft 103.

One-piece cover 106 is preferably a partial cylinder with no ends. The cylindrical radius for one-piece cover 106 is preferably in the range of 1.50 to 3.00 inches, and one-piece cover 106 has an arc extending for 120 degrees, resulting in a preferred arc length in the range of approximately 3.14 to 6.28 inches. One-piece cover 106 is preferably 60.00 inches in length, though the length may vary depending upon the length of the roller 2 used. As shown in FIG. 9, one-piece cover 106 is bent along its bottom edge, forming blade mount 114. Blade mount 114 is a straight, rectangular strip attached to one-piece cover 106. Blade mount 114 is perpendicular to the imaginary line tangent to the arc of one-piece cover 106 at its edge. The length of blade mount 114 is less than the distance between the inner edges of rim cylinders 107 when assembled: approximately 59.25 inches in length. Preferably, six blade mount holes 115 are made through blade mount 114. Two of the blade mount holes 115 are located preferably 5.00 inches from each end of blade mount 114. The remaining four blade mount holes 115 are preferably evenly spaced 10.00 inches apart across blade mount 114. Blade 116 is bolted to blade mount 114. Blade 116 is a rectangular strip, wider than blade mount 114. Thus blade 116 extends beyond blade mount 114 and beyond the inner circumference of one-piece cover 106. One edge of blade 116 is preferably located in the range of 0.03125 to 0.125 inches from the roller surface 3. Being so close to roller surface 3, blade 116 acts as a seal, maximizing the amount of gas trapped inside one-piece cover 106. Blade 116 is preferably made of rubber, though any other suitable material may used. One-piece cover 106 is secured to rims 105 by means of cover set screws 117, as shown in FIGS. 8 and 9.

As can be seen in FIGS. 8 and 9, one or more cover holes 118 are made along a longitudinal line located near the midpoint of the arc of one-piece cover 106. Cover holes 118 are preferably approximately 0.625 inches in diameter. Forced pressure conduits 101 or suction pressure conduits 102, depending upon the particular application, are attached to the perimeter of cover holes 118, as shown in FIG. 9. When power source 11 provides a forced pressure, one or more cover holes 118 and one or more forced pressure conduits 101 are preferably located near the midpoint of one-piece cover 106. When power source 11 provides a suction pressure, cover holes 118 and suction pressure conduits 102 are preferably located at both ends of one-piece cover 106, within 10.00 inches from the ends of one-piece cover 106. One-piece cover 106 and rims 105 are each preferably made of one piece of steel through a sheet-metal forming process, involving punching, stamping, bending, and forming.

As shown in FIGS. 8 and 9, one-piece duct 100 may be assembled by inserting one-piece cover 106 into the rim slots 111 of rims 105. One-piece duct 100 is assembled by fitting one rim 105 onto one end of internal shaft 103 and securing it with a rim set screw 113. Next, one-piece cover 106 is inserted into rim slot 111 of the secured rim 105. Finally, the other rim 105 is fit onto the other end of internal shaft 103, the end of one-piece cover 106 is inserted into rim slot 111, and rim 105 is secured onto internal shaft 103 with a rim set screw 113. The inner circumference of one-piece cover 106 is preferably located in the range of 0.125 to 0.50 inches away from roller surface 3.

If one cover hole 118 and one forced pressure conduit 101 are used, tube 119, preferably a flexible hose, is directly connected to forced pressure conduit 101. Tube 119 may be a flexible hose, a rigid pipe, or tubing of any kind suitable for the application. Tube 119 has a diameter slightly larger than the diameter of forced pressure conduit 101, as can be seen in FIG. 7. Tube 119 is preferably connected to forced pressure conduit 101 by means of a hose clamp or any other suitable fastener.

If more than one cover hole 118 and forced pressure conduit 101 or suction pressure conduit 102 are used, manifold 120 is connected to one-piece cover 106. As shown in FIG. 9, manifold 120 is preferably a rectangular-shaped box. One side of manifold 120 has a single manifold hole 121 in its wall, preferably approximately 0.75 inches in diameter. Single manifold cylinder 122 is connected to the perimeter of single manifold hole 121, having a preferable approximate diameter of 0.75 inches. Another side of manifold 120 has multiple manifold holes 123 in its wall, equal to the number of cover holes 118 in one-piece cover 106. For each multiple manifold hole 123, multiple manifold cylinder 124 is connected to the perimeter of such multiple manifold hole 123. The diameter of multiple manifold cylinders 124 is slightly smaller than the diameter of tube 119. Tubes 119 are connected to multiple manifold cylinders 124 by means of a hose clamp or any other suitable fastener. Manifold 120 is preferably made of one piece of steel through a sheet-metal forming process, involving punching, stamping, bending, and forming.

As shown in FIG. 9, tube 119 is connected to power source 11 by means of a hose clamp or any other suitable fastening means. Power source 11 is preferably a pump having heating and cooling capabilities, which can provide forced pressure or suction pressure. Power source 11 may be any system capable of providing forced pressure or suction pressure, and a means to regulate gas temperature, a means to vary gas moisture levels, or a means to store or dispose of debris.

Figure 10:
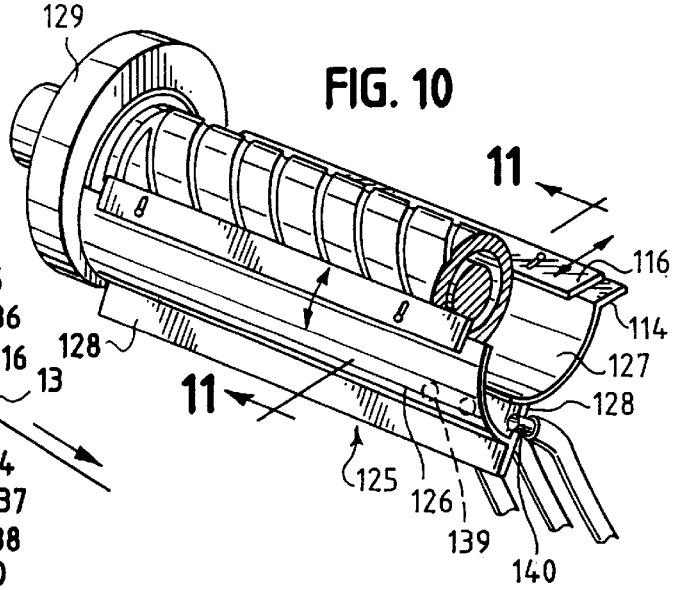
FIG. 10 is a perspective view of the two-piece duct for the first embodiment of the present invention.
Figure 11:
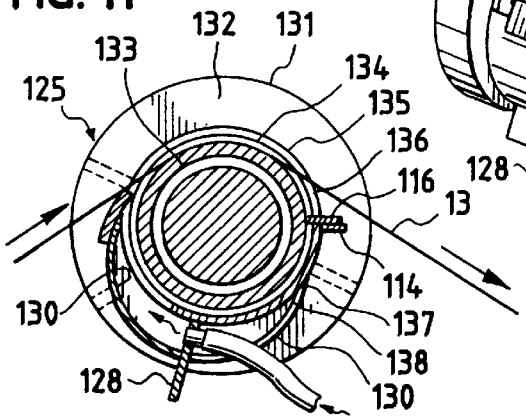
FIG. 11 is cross-sectional view of the two-piece duct for the first embodiment of the present invention.

As an alternative to one-piece duct 100, a two-piece duct 125 may be used. As shown in FIGS. 10 and 11, two-piece duct 125 has an outer cover 126 and an inner cover 127, both having the same size and shape as one-piece cover 106. However, outer cover 126 has wall 128 attached to its edge, as shown in FIGS. 10 and 11. Wall 128 is preferably the same length as blade mount 114 and approximately 59.25 inches in width.

Dual slot rims 129 are the same shape as rims 105 except they contain an additional outer slot 130 for outer cover 126. Dual slot rims 129 are also substantially larger than rims 105. Dual slot rims 129 are made of rim cylinders 131 having a circular rim cap 132 on one end of each rim cylinder 131. Rim cap 132 has the same diameter as rim cylinders 131. A rim hole 133, slightly larger than the diameter of internal shaft 103, is formed through the center of rim cap 132. Inner rim cylinder 134 has a smaller diameter than rim cylinder 131, a larger diameter than rim hole 133, and no end caps. Inner rim cylinder 134 is attached to rim cap 132 on the inside of rim cylinder 131. Outer rim cylinders 135 are the same shape as inner rim cylinders 134 except the diameter of outer rim cylinder 135 is slightly larger than the diameter of inner rim cylinder 134. Outer rim cylinders 135 are attached to rim cap 132 on the inside of rim cylinders 131, encircling inner rim cylinders 134. Inner slot 136 is the empty space between outer rim cylinders 135 and inner rim cylinder 134.

Outer rim semi-cylinders 137 are attached to rim caps 132 and located within rim cylinders 131, as shown in FIG. 11. Inner rim semi-cylinders 138, having a diameter slightly smaller than outer rim semi-cylinders 137, are also attached to rim caps 132. The edges of outer rim semi-cylinder 137 and inner rim semi-cylinders 138 adjoin outer rim cylinder 135. The length of outer rim semi-cylinders 137 and inner rim semi-cylinders 138 is the same as inner rim cylinders 134 and outer rim cylinders 135. Outer slot 130 is the empty space between outer rim semi-cylinders 137 and inner rim semi-cylinders 138.

In the assembly of two-piece duct 125, the edges of outer cover 126 fit into the outer slot 130, securing outer cover 126 to dual slot rims 129. The edges of inner cover 127 fit into the inner slot 136, and the length-wise edge of inner cover 127 adjoins wall 128, as shown in FIGS. 10 and 11. Set screws, not shown, used in the same manner as in one-piece duct 100, are used to secure outer cover 126 and inner cover 127 to dual slot rims 129 and to secure dual slot rims 129 to internal shaft 103. One or more wall holes 139 are formed through wall 128, having diameters smaller than the diameter of tube 119. Wall hole cylinders 140 are connected to each wall hole 139, as shown in FIGS. 10 and 11. Tubes 119 are attached to wall hole cylinders 140 by means of hose clamps or any other suitable fastener. Outer cover 126, inner cover 127, and dual slot rims 129 are each preferably made of one piece of steel through a sheet-metal forming process, involving punching, stamping, bending, and forming.

Two-piece duct 125 allows for a substantially larger volume of gas pressure to accumulate than does one-piece duct 100. The two-piece duct 125 also covers a greater portion of roller surface 3 than does one-piece duct 100. This increase in gas volume and surface area enhances the performance of the web pressurizing channeled roller 1, which may be appropriate for particular applications.

In operation, when used to provide forced pressure, power source 11 sends pressurized gas through tube 119, through manifold 120, if used, and into one-piece duct 100 or two-piece duct 125, whichever the case may be. The gas flows onto rotating roller 2, hits roller surface 3, and is redirected towards one-piece duct 100 or two-piece duct 125. The pressure between roller surface 3 and one-piece duct 100 or two-piece duct 125 accumulates and increases until the pressure is great enough to force gas into reservoir 7 and also directly into channels 4. The preferred operating pressure is within the range of 2.00 to 50.00 pounds per square inch, though the operating pressure is material and specific job dependent. As gas flows through channels 4, pressure is applied to web 13 as described in detail above, removing wrinkles, preventing wrinkle formation, and having the ability to provide various kinds of treatment for web 13.

When used to provide suction pressure, power source 11 draws air through tube 119, through manifold 120, if used, through one-piece duct 100 or two-piece duct 125, whichever the case may be, through end channels 6, and through channels 4. A vacuum is created between roller surface 3 and one-piece duct 100 or two-piece duct 125, whichever the case may be. Suction forces are then applied to web 13. As described earlier, the suction forces remove wrinkles, prevent wrinkle formation, and can be used to provide various kinds of treatment for web 13.

Figure 12:
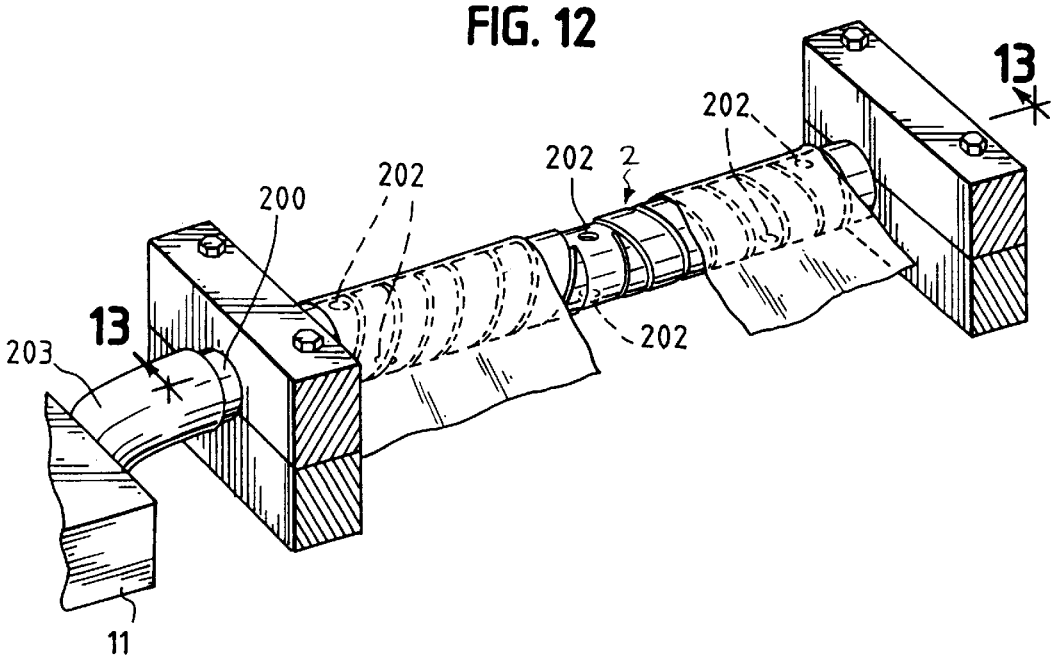
FIG. 12 is a perspective view of the second embodiment of the present invention.
Figure 13:
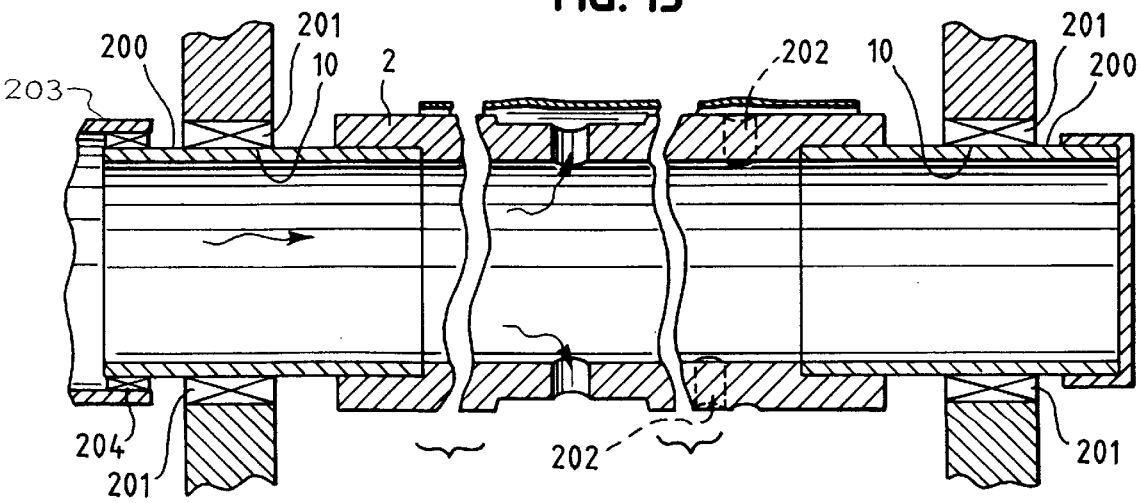
FIG. 13 is a cross-sectional view of the second embodiment of the present invention.

In a second preferred embodiment, shown in FIGS. 12 and 13, gas is supplied directly to the interior of roller 2. Internal shaft 103 is not used but rather sub-shafts 200 extend from the ends of roller 2 as shown in FIG. 13. Sub-shafts 200 are cylindrical tubes, preferably made of cold rolled steel. The diameter of sub-shaft 200 is slightly larger than the inside diameter of roller 2, so as to enable press-fitting into roller 2. The length of each sub-shaft 200 is preferably approximately 12.00 inches. Preferably, approximately 4.00 inches of each sub-shaft 200 fit into roller 2, preferably by means of press-fitting. Preferably, approximately 8.00 inches of sub-shaft 200 protrude from roller 2. The protruding end of one of the two sub-shafts 200 is closed with a steel cap, core or any other suitable closure. The protruding end of the other sub-shaft 200 is open-ended. Thus, gas can flow through sub-shaft 200 but cannot exit the end of the other sub-shaft 200. Sub-shaft roller bearings 201 are fit onto the ends of sub-shafts 200, as shown in FIG. 13. Sub-shaft roller bearings 201 are held in place on sub-shafts 200 by means of set screws, not shown. The outer diameter of sub-shaft roller bearings 201 is approximately equal to the inside diameter of mount holes 10. Sub-shafts 200 are securely inserted into mount holes 10, and the only contact between sub-shafts 200 and mount holes 10 is through sub-shaft roller bearings 201. As such, roller 2 freely rotates at mount holes 10.

In addition, the second preferred embodiment has one or more roller holes 202 in roller surface 2, as shown in FIGS. 12 and 13. Roller holes 202 are preferably in the range of 0.75 to 1.25 inches in diameter.

For forced pressure operation, preferably two roller holes 202 are made, both located near the mid-point of roller surface 3, at reservoir 7. For suction pressure operation, preferably two roller holes 202 are located at each end of roller 2, totaling four roller holes 202. Roller holes 202 are preferably separated by an equal arc length depending upon the number of roller holes 202 used.

Conduit 203 is connected to the end of the open-ended sub-shaft 200. Conduit 203 may be a flexible hose, a rigid pipe, or tubing of any kind suitable for the application. Conduit 203 has a diameter slightly larger than the diameter of the open-ended sub-shaft 200. The open-ended sub-shaft 200 is threaded at its end. Conduit 203 is preferably attached to the end of the open-ended sub-shaft 200 by means of sub-shaft rotary joint 204. The other end of conduit 203 is connected to power source 11. Sub-shaft rotary joint 204 allows roller 2 and sub-shafts 200 to rotate without causing conduit 203 to rotate.

In forced pressure operation, power source 11 provides pressurized gas into conduit 203 and through the open ended sub-shaft 200. As pressure accumulates and increases inside roller 2, gas flows out of roller holes 202, which are located near the mid-point of roller surface 3. The preferred operating pressure is within the range of 2.00 to 50.00 pounds per square inch, though the operating pressure is material and specific job dependent. As roller 2 rotates, there are instances when roller holes 202 come into contact with the underside of web 13. At these instances, the gas flowing out of roller holes 202, runs into the underside of web 13. Web 13 forms a boundary, re-directing the gas onto the roller surface 3 and into channels 4. The pressurized gas is forced through the channels 4, creating a continuous flow. The gas then flows circumferentially around the cylindrical surface toward the ends of roller 2. Gas flow 12 creates pressure forces upon web 13 which remove wrinkles and prevents wrinkle formation, as described earlier, and which can be used for other forms of web treatment as described earlier.

In suction pressure operation, roller holes 202 are located near the ends of roller 2, preferably at least two on each end, disposed as described above. In operation, power source 11 vacuums air through conduit 203 and through the open-ended sub-shaft 200. As a vacuum accumulates and increases inside roller 2, air flows through roller holes 202, and a vacuum is created between the underside of web 13 and roller surface 3. The preferred operating vacuum pressure is within the range of 2.00 to 20.00 pounds per square inch, though the operating vacuum pressure is material and specific job dependent. This vacuum draws in air from end channels 6 and channels 4. The air flows from the mid-point of the roller surface 3 towards each end of roller 2. The air flows circumferentially around the cylindrical surface as it travels towards roller holes 202 at the ends of roller surface 3. Suction forces are created on web 13, which remove wrinkles and prevent wrinkle formation, as described in detail above. Suction forces may also be used for various kinds of web treatment as described above.

The present invention may be embodied in still other specific forms without departing from the spirit or essential attributes thereof and, accordingly, the described embodiments are to be considered in all respects as being illustrative and not restrictive, with the scope of the invention being indicated by the appended claims, rather than the foregoing detailed description. Furthermore, the appended claims indicate the scope of the invention, as well as all modifications which may fall within a range of equivalency, which are also intended to be embraced therein.

I claim:

1. A method of removing wrinkles from a web, comprising:

providing a roller, rotatably supported, the roller having channels forming a channeled surface, the channeled surface having a chevron configuration near a mid-point of the roller;

supplying the channels with a gas flow, the gas flow providing non-contact forces, the non-contact forces being applied to the web; and removing wrinkles in the web by means of the non-contact forces.

2. The method of claim 1, wherein the non-contact forces cause a stretching of the web.

3. The method of claim 1, wherein the non-contact forces cause a displacement of the web.

4. A method of treating a web, comprising:

providing a roller, rotatably supported, the roller having channels forming a channeled surface, the channeled surface having a chevron configuration near a mid-point of the roller;

supplying the channels with a flow of gas which provides non-contact forces, the non-contact forces being applied to the web, the web having physical characteristics; and changing the physical characteristics of the web by means of the gas being applied to the web.

5. The method of claim 4, wherein the gas is used to moisturize the web.

6. The method of claim 4, wherein the gas is used to dry the web.

7. The method of claim 4, wherein the gas is used to heat the web.

8. The method of claim 4, wherein the gas is used to cool the web.

9. A method of braking a roller, comprising:

providing a roller, rotatably supported, having an axis of rotation, an axis perpendicular to the axis of rotation, and a direction of rotation, the roller having channels forming a channeled surface, the channeled surface having a chevron configuration near a mid-point of the roller, the channels formed at an angle in the range of 5.00 to 30.00 degrees with respect to the axis perpendicular to the axis of rotation;

supplying the channels with a gas flow, the gas flow providing non-contact forces, the non-contact forces being applied to the channeled surface and the web; and braking the roller by means of providing a direction of gas flow that opposes the direction of rotation.

10. A method of cleaning a roller and a web, comprising:

providing a roller, rotatably supported, the roller having channels forming a channeled surface, the channeled surface having a chevron configuration near a mid-point of the roller;

supplying the channels with a gas flow, the gas flow providing non-contact suction forces, the non-contact suction forces being applied to the roller and the web; and removing debris from the roller and the web by means of the non-contact suction forces.

11. A web pressurizing channeled roller for removing wrinkles in a web, comprising:

a roller, rotatably supported, the roller having channels forming a channeled surface, the channeled surface having a chevron configuration near a mid-point of the roller;

a power source providing a pressure;

a means of delivering the pressure from the power source to the channels; and the pressure inducing a gas flow through the channels, the gas flow exerting non-contact pressure forces on the web, the non-contact pressure forces being applied to the web so as to remove wrinkles in the web.

12. The means of delivery of the web pressurizing channeled roller according to claim 11, further comprising:

a duct connected to the power source, the duct being located in close proximity to the channeled surface.

13. The means of delivery of the web pressurizing channeled roller according to claim 11, further comprising:

the roller being a hollow shaft connected to the power source and the roller having one or more holes in the channeled surface.

14. A web pressurizing channeled roller for treating a web, comprising:

a roller, rotatably supported, the roller having channels forming a channeled surface, the channeled surface having a chevron configuration near a mid-point of the roller;

a power source providing a pressure;

a means of delivering the pressure from the power source to the channels; and the pressure inducing a gas flow through the channels, the gas flow exerting non-contact pressure forces on the web, the web having physical characteristics, the non-contact pressure forces being applied to the web so as to change the physical characteristics of the web.

15. The web pressurizing channeled roller of claim 14, wherein the gas flow is used to moisturize the web.

16. The web pressurizing channeled roller of claim 14, wherein the gas flow is used to dry the web.

17. The web pressurizing channeled roller of claim 14, wherein the gas flow is used to heat the web.

18. The web pressurizing channeled roller of claim 14, wherein the gas flow is used to cool the web.

19. A web pressurizing channeled roller for braking a web, comprising:

a roller, rotatably supported, having an axis of rotation, an axis perpendicular to the axis of rotation, and a direction of rotation, the roller having channels forming a channeled surface, the channeled surface having a chevron configuration near a mid-point of the roller, the channels formed at an angle in the range of 5.00 to 30.00 degrees with respect to the axis perpendicular to the axis of rotation;

a power source providing a pressure;

a means of delivering the pressure from the power source to the channels; and the pressure inducing a gas flow through the channels, the gas flow exerting non-contact pressure forces on the channeled surface and the web, the direction of gas flow opposing the direction of rotation of the roller so as to brake the roller.

20. A web pressurizing channeled roller for cleaning a roller and a web, comprising:

a roller, rotatably supported, the roller having channels forming a channeled surface, the channeled surface having a chevron configuration near a mid-point of the roller;

a power source providing a pressure;

a means of delivering the pressure from the power source to the channels; and the pressure inducing a gas flow through the channels, the gas flow exerting non-contact suction forces on the web, the non-contact suction forces being applied to the web so as to remove debris from the roller and the web.

* * * * *